US007425102B1

(12) United States Patent
Velliquette

(10) Patent No.: US 7,425,102 B1
(45) Date of Patent: Sep. 16, 2008

(54) FLUID FLOW CONTROL VALVE/SEAL FOR FLUID DISPENSERS

(76) Inventor: Stephen P. Velliquette, 4411 Bee Ridge Rd., #593, Sarasota, FL (US) 34233

( * ) Notice: Subject to any disclaimer, the term of this patent is extended or adjusted under 35 U.S.C. 154(b) by 0 days.

(21) Appl. No.: 11/712,721

(22) Filed: Mar. 1, 2007

(51) Int. Cl.
*B43M 11/06* (2006.01)

(52) U.S. Cl. ..... 401/186; 401/271

(58) Field of Classification Search ..... 401/186, 401/205, 263, 270, 271
See application file for complete search history.

(56) References Cited

U.S. PATENT DOCUMENTS

| | | | | |
|---|---|---|---|---|
| 2,135,237 | A | | 11/1938 | Lewis et al. |
| 3,586,068 | A | | 6/1971 | Nicholson |
| 3,618,825 | A | | 11/1971 | Clarke |
| 3,878,972 | A | | 4/1975 | Por |
| 3,937,364 | A | * | 2/1976 | Wright ..... 222/190 |
| 3,963,150 | A | | 6/1976 | Steiman et al. |
| 3,985,271 | A | * | 10/1976 | Gardner ..... 222/190 |
| 4,090,647 | A | | 5/1978 | Dunning |
| 4,179,051 | A | | 12/1979 | Thomas |
| 4,420,101 | A | | 12/1983 | O'Neill |
| 4,483,465 | A | | 11/1984 | Lawrence |
| 5,071,017 | A | | 12/1991 | Stull |
| 5,388,728 | A | * | 2/1995 | Gueret ..... 222/105 |
| D359,970 | S | | 7/1995 | Szabo |
| 5,492,253 | A | | 2/1996 | Proshan |
| 5,551,599 | A | | 9/1996 | Niss |
| 5,553,957 | A | * | 9/1996 | Dornbusch et al. ..... 401/209 |
| 5,641,233 | A | | 6/1997 | Wilson |
| 5,839,626 | A | | 11/1998 | Gross et al. |
| 5,927,566 | A | | 7/1999 | Mueller |
| 5,927,567 | A | | 7/1999 | Fillmore |
| 5,934,514 | A | | 8/1999 | Lampe et al. |
| 6,062,439 | A | | 5/2000 | Ambs et al. |
| 6,089,419 | A | | 7/2000 | Gross |
| 6,315,483 | B1 | | 11/2001 | Velliquette |
| 6,662,973 | B1 | | 12/2003 | Velliquette |

* cited by examiner

*Primary Examiner*—Huyen Le
(74) *Attorney, Agent, or Firm*—Charles J. Prescott

(57) ABSTRACT

A fluid flow control valve for use in a fluid applicator tip which is connectable onto an open end of a resiliently squeezable container. The valve includes a valve body defining a flow aperture formed centrally therethrough. A separate sealing ball is held in coaxial alignment and gravity biased seated against the flow aperture and oriented downstream of fluid flow through the flow aperture from the open end of the container. The valve is thus normally closed and opens or unseats automatically when at least partially inverted to permit fluid to flow through the fluid aperture when the container is held in at least a somewhat inverted orientation and squeezed to increase fluid pressure to open or unseat the sealing ball. The sealing ball automatically reseats when the container is righted and there is no substantial pressure within the container, preventing virtually all air from drying the fluid within the container.

3 Claims, 3 Drawing Sheets

FLUID FLOW CONTROL VALVE/SEAL FOR FLUID DISPENSERS

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to fluid dispensers, and more particularly to a fluid flow control valve for also preventing evaporative drying and thickening of the fluid and inadvertent fluid spillage or leakage from such fluid dispensers.

2. Description of Related Art

In dispensing light fluids from a squeezable fluid dispenser, many times more fluid than needed is inadvertently forced from the container or reservoir. This occurs because there is no convenient means for instantly arresting the flow of fluid from the applicator tip or cap attached to the container itself when inverted for dispensing fluid. Such an applicator tip may take the form of a brush, a grout roller, a spout, a nozzle and the like. Many prior art devices have attempted to resolve this problem of excess fluid dispensing and dripping, but they have either been too expensive or difficult to manufacture or failed to operate as intended.

U.S. Pat. No. 5,927,566 invented by Mueller discloses a one-piece dispensing system for a container and a method for making same. The dispensing valve includes an orifice. A dispensing structure with a lid containing a pressure-openable valve is disclosed in U.S. Pat. No. 6,089,419 invented by Gross. The lid includes a flexible valve with self-sealing slits which open to permit flow therethrough in response to pressure on the side of the valve.

Proshan, in U.S. Pat. No. 5,492,253, discloses a cap attachment having a flat disc with a socket adapted to receive the open end of the neck of a container. The disc has a slot centered therein and a vertical spout integral therewith.

U.S. Pat. No. 5,934,514 issued to Lampe, et al. teaches a dispensing valve closure which includes a self-sealing dispensing valve. An inner seal within the closure allows for sealing.

Lawrence, in U.S. Pat. No. 4,483,465, teaches a valve for dispensing fluids. The valve housing has a diaphragm disposed therein having at least one aperture for allowing passage of fluids. A one-piece check valve for use in an applicator tip for dispensing fluids is taught in U.S. Pat. No. 4,179,051 issued to Thomas. The valve comprises a reed and valve seat and a hinge section permitting the reed and valve seat to be folded over so that the reed portion seats on the seat provided by the valve seat portion. Fluid will pass through the check valve but any backflow is prevented by engagement of the reed on the shoulder portion.

Stull, in U.S. Pat. No. 5,071,017 discloses a valve-type closure with a resilient diaphragm containing a slit for the passage of fluids. The slit portion has abuttable, cooperative structures on one side which come into forcible abutment and open the slit as the slit portion bulges.

O'Neill discloses a squeeze container with a self-venting dispensing closure in U.S. Pat. No. 4,420,101. The container cap contains a flexible disc having an annular valve being shiftable to positions upstream and downstream of the valve seat responsive to pressure within the container.

U.S. Pat. No. 5,573,033 teaches a non-drip valve for discharging liquid having at least one elastic member which reduces its volume when the pressure of the fluid increases thereby freeing the through-flow channel.

A flexible vented self-sealing dispensing valve is taught by Fuchs in U.S. Pat. No. 6,062,436. The self-sealing closure assembly includes a dispensing valve of one-piece integrally molded elastic construction with a mouth portion that includes a slit opening oriented diametrically of the annular base.

Dunning teaches a squeeze container with a cap containing a tapered spout with an opening therethrough in U.S. Pat. No. 4,090,647. A closure cap is provided with a tongue to enhance the seal.

U.S. Pat. No. 5,839,626, issued to Gross, et al. teaches a closure having a dispensing valve with an orifice to permit liquid flow therethrough responsive to increased pressure within the container. An outer member on the base of the valve functions as a flow baffle for protecting the valve. A one-piece valve adapted for use in pressurized containers for either charging the container or dispensing the contents therefrom is shown in U.S. Pat. No. 3,586,068. This fluid pressure responsive valve is made as a single unitary piece with fluid passage means formed therein and a plug which is compressible to seal the passages when fluid pressure forces are imposed on the valve. Design Pat. D359,970, issued to Szabo, discloses a plug cap having a slit therethrough.

Applicant's prior U.S. Pat. No. 6,315,483 teaches a one-piece fluid check valve having structure cooperative with the tip of a squeezable fluid dispensing container which automatically self closes the instant that squeezing pressure against the sides of the resilient container is released. Moreover, the invention thereafter allows air to re-enter the container, which has been squeezed and distorted, to resiliently return to its normal configuration without fluid spillage. Applicant has, however, discerned a problem with this invention in that the very feature which allows re-entry of air into the container also results in inadvertent leakage of fluid from the dispenser when not in use and when fluid is placed against the fluid check valve because of container orientation.

In U.S. Pat. No. 5,551,599, Niss teaches a substantially more complex system for dispensing flowing substances from a container via a uniquely configured pump arrangement.

Another of applicant's prior U.S. Pat. No. 6,662,973, provides an improved fluid flow control valve of a squeezable fluid dispensing container which, aided by a bias spring, insures positive sealing of fluid within the container from advertent leakage while also regulating the flow of fluid when the container is squeezed in an inverted orientation. However, because of the delicate and sensitive nature of the seating ball arrangement, inconsistent spring biasing pressure thereagainst has been shown to be problematic in that the biasing pressure is sufficiently inconsistent to detract from overall product quality and consistent functionality.

BRIEF SUMMARY OF THE INVENTION

This invention is directed to a fluid flow control valve for use in a fluid applicator tip which is connectable onto an open end of a resiliently squeezable container. The valve includes a valve body defining a flow aperture formed centrally therethrough. A separate sealing ball is held in coaxial alignment and gravity biased seated against the flow aperture and oriented downstream of fluid flow through the flow aperture from the open end of the container. The movement of the sealing ball is limited in vertical or longitudinal travel to maintain its proximity to the sealing aperture when side squeezing pressure is released from the side of the container. The valve is thus normally closed and opens or unseats automatically when at least partially inverted to permit fluid to flow through the fluid aperture when the container is held in at least a somewhat inverted orientation and squeezed to increase fluid pressure to open or unseat the sealing ball. The sealing ball automatically reseats by gravity when the container is righted and there is no substantial pressure within the container, preventing air from prematurely drying fluid within the container. The sealing ball is also sealed for short time durations when the container is inverted and fluid flow is stopped by releasing side pressure on the container. Fluid remaining within the applicator tip downstream of the sealing ball will be partially retracted inwardly back into the container causing the sealing ball to reseat and remaining negative pressure within the container maintaining this seal while the device is moved to the next substrate for further fluid dispensing by resqueezing the sides of the container.

It is therefore an object of this invention to provide an economical, easy to install fluid control valve for use in fluid applicators having an applicator tip into which the device is insertable.

Still another object of the invention is to provide a fluid control valve for squeezable containers having an applicator tip which not only provides regulated flow and instant fluid flow stoppage, but also prevents fluid drying within the container.

In accordance with these and other objects which will become apparent hereinafter, the instant invention will now be described with reference to the accompanying drawings.

DETAILED DESCRIPTION OF THE INVENTION

Figure 1:
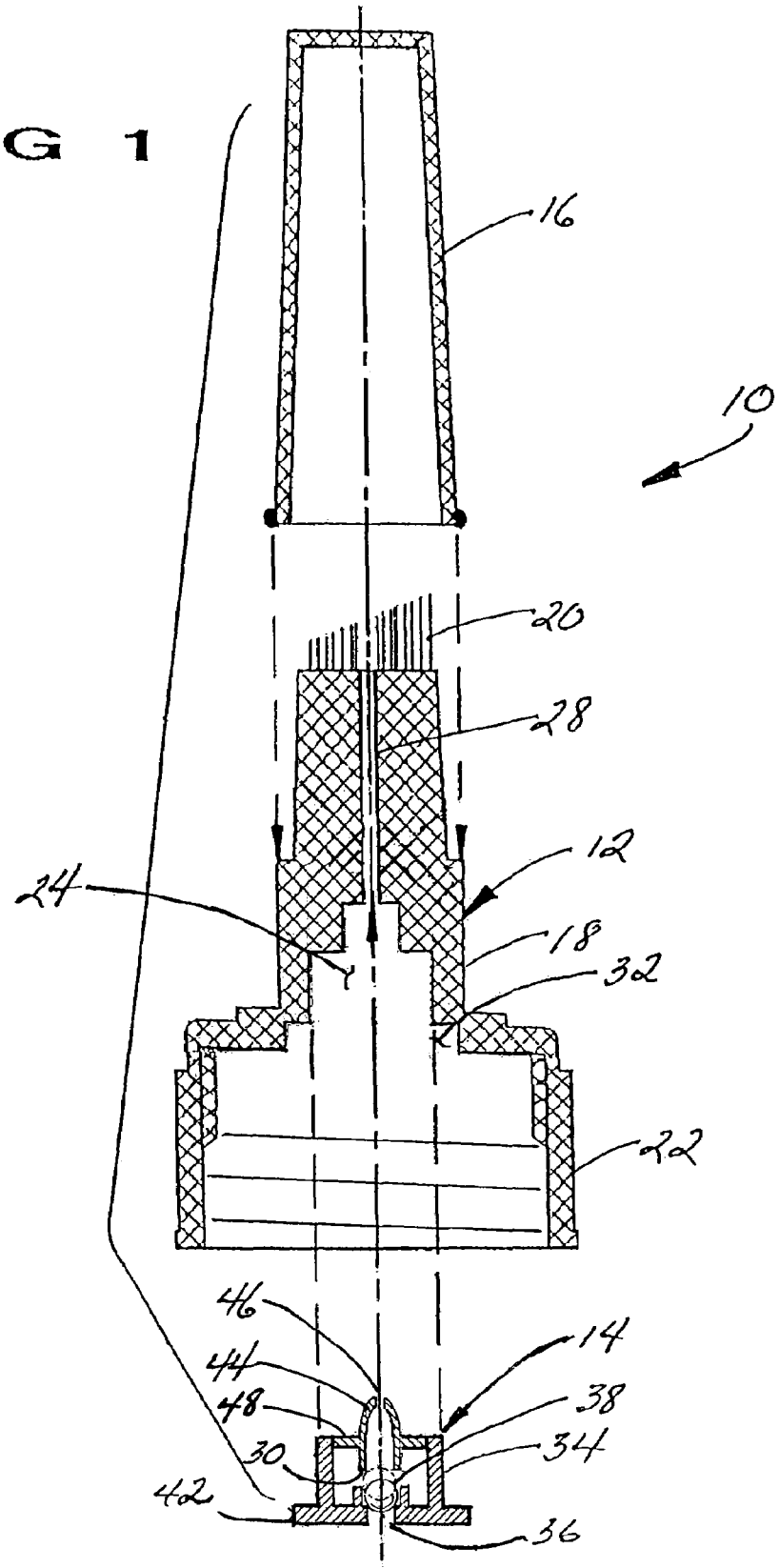
FIG. 1 is a side elevation exploded section view of one embodiment of the invention configured for installation into a cooperatively structured fluid applicator tip including a brush.
Figure 3:
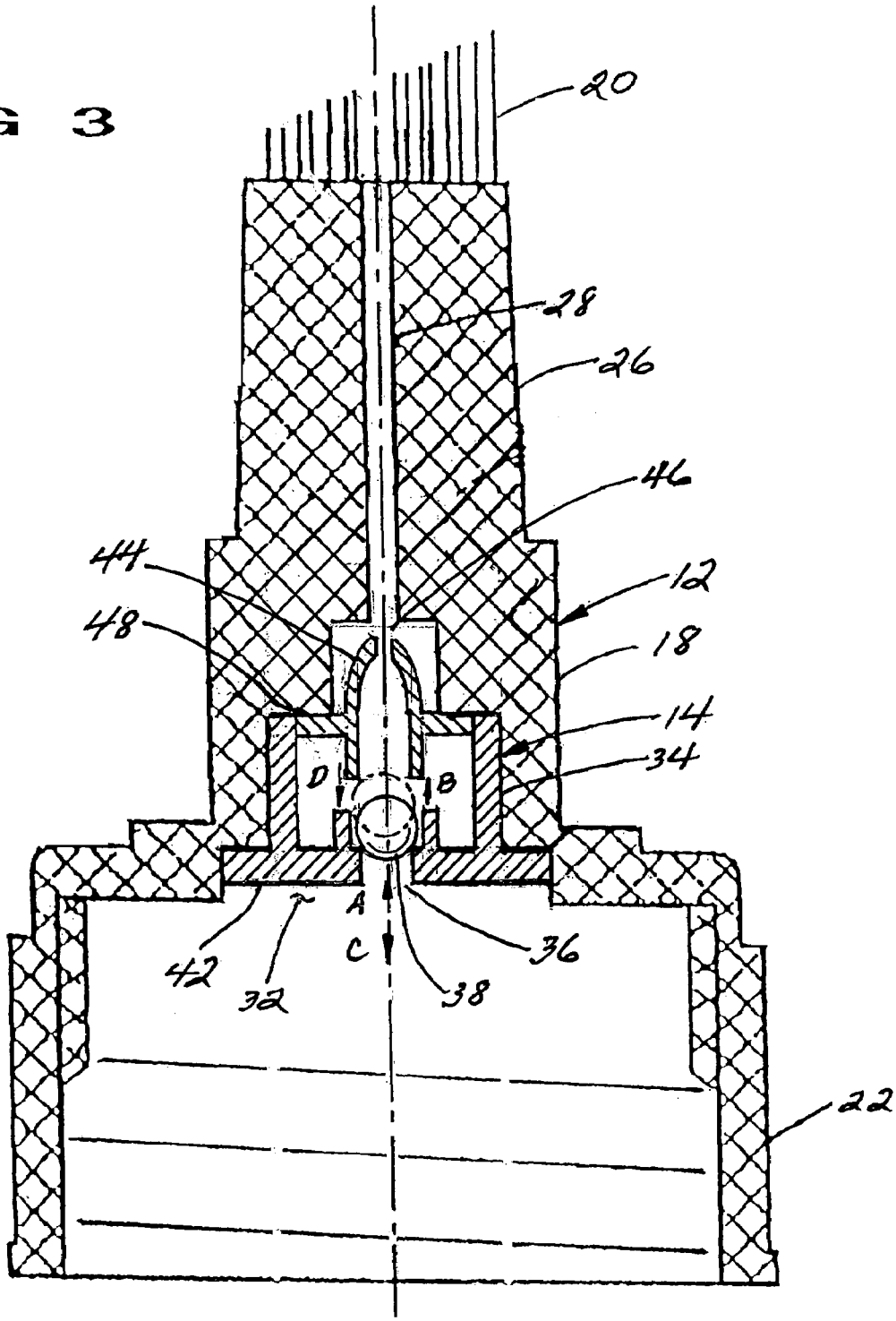
FIG. 3 is an enlarged view of FIG. 1 assembled.

Referring now to the drawings and particularly to FIGS. 1 and 3, one embodiment of the invention which is attachable to a squeezable container (not shown) is generally shown at numeral 10. The container is of a conventional nature typically made of molded plastic material and having a threaded neck. The fluid applicator tip 12 includes an internally threaded portion 22 which matably engages onto the open neck of the container in a conventional manner. The external size of the threaded portion 22 is reduced in stepped fashion as shown by hollow cylindrical segments 18 and 26. Segment 18 has an interior cavity 24 which matably and snugly receives the outer surface of a plastic valve body 34 of a fluid flow control valve shown generally at 14. The control valve 14 also includes a cup-shaped metering member 44 which is held in position within the upper end of the valve body 34 by a flange 48. The upper distal end 46 of this metering cup 44 meters fluid flow and maximum fluid flow rate through the control valve 14 into the hollow cylindrical fluid passage 28, the diameter of this metering orifice 46 being substantially smaller than that of either flow aperture 36 or the fluid passage 28.

The sealing ball 38 is limited in its travel in the direction of arrow B by the proximal open end 30 of the metering member 44 so that two return or sealing movement factors are at work to move the sealing ball 38 in the direction of arrow D back to is sealed position within the flow aperture 36. In addition, when the container is squeezed in an inverted orientation, fluid will discharge from the container, moving the sealing ball 38 in the direction of arrow B as fluid flows outwardly from the flow aperture 36 in the direction of arrow A. While still in an inverted position such as at the end of a fluid dispensing movement, the container may be released whereupon fluid still remaining within the fluid passage 28 will be suctioned in the direction of arrow C back through the flow aperture 36. As this reverse fluid flow in the direction of arrow C back into the container through the flow aperture 36 occurs, the sealing ball 38 will quickly move in the direction of arrow D to also reseal itself against the flow aperture 36. This typically occurs well before all of the negative pressure within the container (because the container is not completely filled with fluids, occurs. Thus, each time the sides of the container are released, the sealing ball 38 is reseated, the remaining negative pressure within the container will maintain the seal between the sealing ball 38 and the flow aperture 36 while the device 10 is moved to the next work station or segment whereupon resqueezing of the container will then further discharge fluid as above described.

The distal or downstream end of the applicator tip 12 includes a molded brush tip 20 formed of flexible synthetic bristles which are heat formed together with a narrow elongated fluid passage 28 formed centrally there into for fluid passage from the applicator tip 12 into the bristles 20 for dispensing fluid onto a work surface. The fluid passage 28 also limits the maximum flow of fluid therethrough by design choice. A protective cap 16 covers the bristles when not in use.

The valve body 34, which may be resilient for enhanced sealing, includes a centrally aligned flow aperture 36 which is sized to be closed from fluid flow therethrough by a separate free-floating spherical sealing ball 38. Gravity maintains a biased force against the sealing ball 38 when the container is upright so as to maintain sealing engagement with the flow aperture 36 and to prevent air from gaining access into the container causing the fluid to prematurely dry or thicken by evaporation. The valve body 34 also includes a flange 42 which snapably engages into securing cavity 32 of the applicator tip 12. The main portion of the valve body 34 is forcibly engaged into cavity 24 as flange 42 is engaged into the securing cavity 32.

In operation, the applicator tip 12, threadably attached to the neck of a fluid filled container (not shown) will allow fluid within the container to flow as the container is at least partially inverted so that fluid within the container is against the sealing ball 38 and at least partially within the flow aperture 36. By merely then squeezing the flexible container, fluid pressure is increased sufficiently to unseat the sealing ball 38 with or against gravity. Fluid will then flow through the elongated passageway 28 and through the bristles 20 for dispensing and spreading onto a working surface. Importantly to repeat the above, by releasing pressure on the side of the container, fluid is retracted or withdrawn back into the container and in doing so, reseals the sealing ball so that the device may be carried to the next work station in a generally inverted orientation without fluid leakage.

As should now be understood, the two most important aspects of the invention are (1) to prevent fluid leakage when the device is in an inverted orientation in between successive applications of fluid to work areas and (2) to prevent inadvertent fluid evaporative drying or thickening or spillage from the container. These are accomplished by the arrangement of the fluid flow control valve 14 and gravity biasingly urging and maintaining the sealing ball 34 against the flow aperture 36 until such time as sufficient fluid pressure by container squeezing is produced to overcome the sealing of the sealing ball 38 by gravity against the flow aperture 36. The protective cap 16 snapably engages onto an annular bead 34 formed around the applicator tip body 18 to protect the bristles when the device is not in use.

Figure 2:
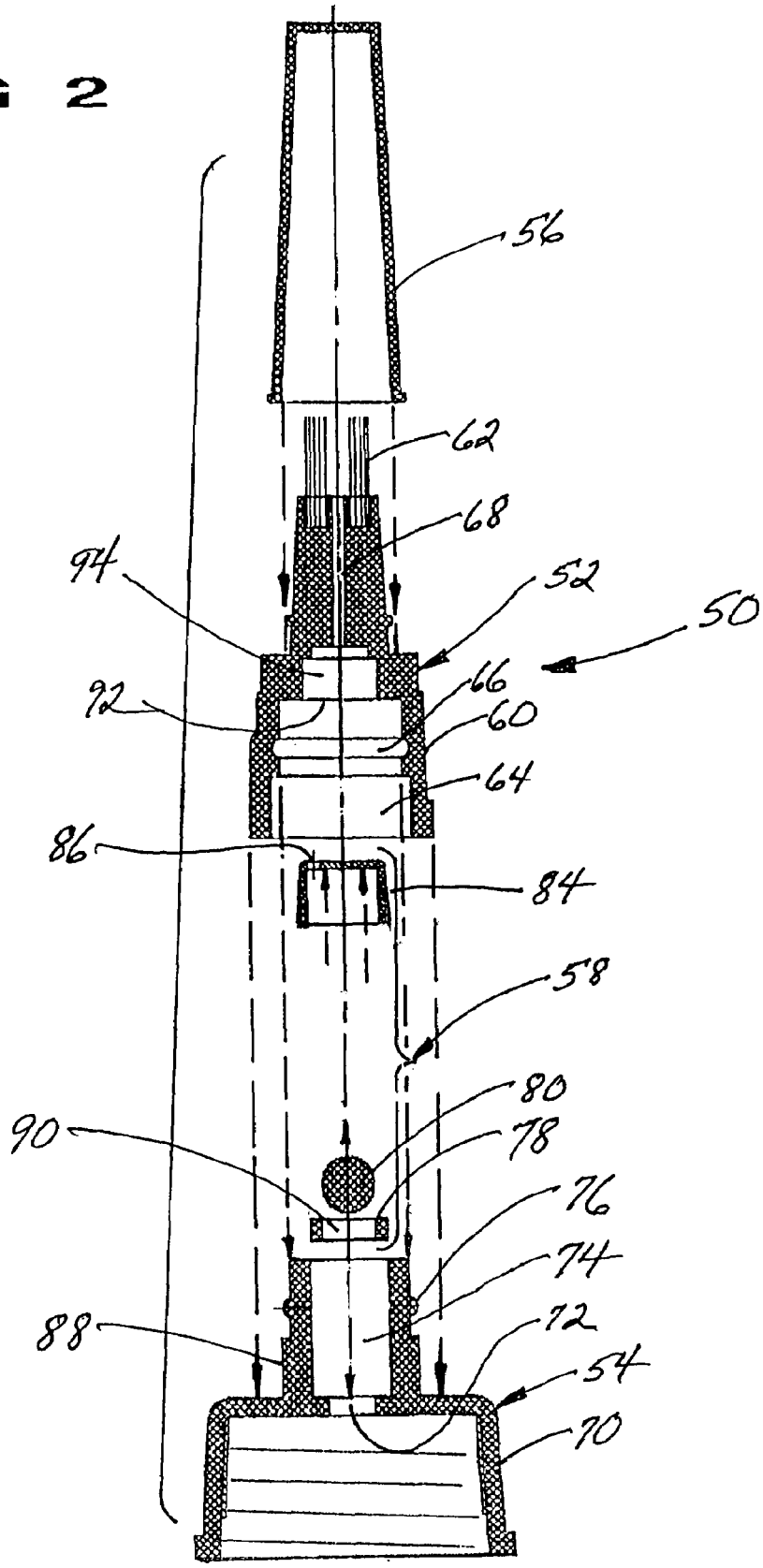
FIG. 2 is a side elevation exploded section view of an alternate embodiment of a fluid flow control valve similar to that shown in FIG. 1.

Referring now to FIG. 2, another embodiment of the invention is there shown generally at numeral 50 and includes an applicator tip 52 which is snapably engaged by undercut locking ring 66 onto an annular locking bead 76 of a container engaging portion 54. A fluid flow control valve shown generally at 58 includes a valve body 78 having a central aperture 90 centrally formed therethrough which is sealably closable at its downstream side by a spherical sealing ball 80.

With the valve body 78 positioned at the bottom of cavity 74 of the container engaging member 54 in alignment with aperture 72, gravity acts to maintain the sealing ball 80 against the downstream side of flow aperture 90 to prevent premature fluid dry out in the container. A separate cup-shaped metering member 84 is snugly positioned within and at the upper end of cavity 74 with the downstream end thereof against surface 92. The metering member 84 is provided with an orifice 86, preferably offset from the center of the metering member 84, which meters fluid flow and maximum fluid flow rate through the fluid flow control valve 58 into cavity 94 and fluid passage 68, the diameter or area of the metering orifice 86 being substantially smaller than that of flow aperture 90.

Note as generally above described that the length of the metering member 84 limits the longitudinal travel of the sealing ball 80 to about ⅛" so that gravity will quickly act when the container is turned upright to cause the sealing ball 80 to seat against the valve body 78 to prevent evaporative loss of the fluid. Further, when the squeezing pressure against the container is released as above described, fluid will be sucked back toward the container from the fluid passageway 68 and cavity 94 to quickly reseat the sealing ball before all of the negative or suction pressure within the container is relieved to prevent fluid leakage while maintaining the device in an inverted position in between work stations or segments to be coated with fluid.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

The invention claimed is:

1. A fluid flow control valve for use in a fluid applicator tip which is connectable onto an open end of a resiliently squeezable container, comprising:

a valve body including a central flow aperture having a sealing seat;

a separate sealing ball configured for coaxial alignment and seated retention against said flow aperture and said sealing seat, respectively, within the applicator tip with said sealing ball oriented downstream of fluid flow through said flow aperture;

said valve body being normally biased closed by gravity acting against said sealing ball to permit fluid to flow through said flow aperture when the container is at least partially inverted or squeezed to unseat said sealing ball from said sealing seat;

said sealing ball automatically re-seating itself against said sealing seat by gravity when the container is righted, thus preventing substantially all air from access into the container to prematurely dry the fluid within the container;

a metering cup positioned within the applicator tip and having a metering orifice formed through a bottom of said metering cup, said metering orifice being substantially smaller in diameter than that of said flow aperture wherein maximum fluid flow rate from the container through said fluid control valve is limited substantially by said metering orifice;

said sealing ball automatically re-seating itself against said sealing seat when squeezing pressure against the sides of the inverted container is released and fluid within the applicator tip is sucked back into the bottle thus substantially preventing fluid dripping from the inverted container when the container is moved to another work area.

2. In combination, a fluid flow control valve within a fluid applicator tip which is connectable onto an open end of a resiliently squeezable container, said flow control valve, comprising:

a valve body including a central flow aperture having a sealing seat;

a separate sealing ball configured for coaxial alignment and seated retention against said flow aperture and said sealing seat, respectively, within the applicator tip with said sealing ball oriented downstream of fluid flow through said flow aperture;

said valve body being normally biased closed by gravity acting against said sealing ball to permit fluid to flow through said flow aperture when the container is at least partially inverted or squeezed to unseat said sealing ball from said sealing seat;

said sealing ball automatically re-seating itself against said sealing seat by gravity when the container is righted thus preventing fluid evaporative drying within the container;

a metering cup positioned within the applicator tip having a metering orifice formed through a bottom of said metering cup, said metering orifice being substantially smaller in diameter than that of said flow aperture wherein maximum fluid flow rate from the container through said fluid control valve is limited substantially only by said metering orifice;

said sealing ball automatically re-seating itself against said sealing seat when squeezing pressure against the sides of the inverted container is released and fluid within the applicator tip is sucked back into the bottle thus substantially preventing fluid dripping from the inverted container when the container is moved to another work area.

3. A fluid flow control valve for use in a fluid applicator tip which is connectable onto an open end of a resiliently squeezable container, comprising:

a valve body including a central flow aperture having a sealing seat;

a separate sealing ball configured for coaxial alignment and seated retention against said flow aperture and said sealing seat, respectively, within the applicator tip with said sealing ball oriented downstream of fluid flow through said flow aperture;

said valve body being normally biased closed by gravity acting against said sealing ball to permit fluid to flow through said flow aperture when the container is at least partially inverted or squeezed to unseat said sealing ball from said sealing seat;

said sealing ball automatically re-seating itself against said sealing seat by gravity when the container is righted, thus preventing substantially all air from access into the container to prematurely dry the fluid within the container;

said sealing ball automatically re-seating itself against said sealing seat when squeezing pressure against the sides of the inverted container is released and fluid within the applicator tip is sucked back into the bottle thus substantially preventing fluid dripping from the inverted container when the container is moved to another work area.

* * * * *